US010226658B2

(12) United States Patent
Scott

(10) Patent No.: US 10,226,658 B2
(45) Date of Patent: Mar. 12, 2019

(54) APPARATUS FOR PHYSICAL EXERCISE

(71) Applicant: Steve Scott, Hillsborough (GB)

(72) Inventor: Steve Scott, Hillsborough (GB)

( * ) Notice: Subject to any disclaimer, the term of this patent is extended or adjusted under 35 U.S.C. 154(b) by 207 days.

(21) Appl. No.: 15/035,373

(22) PCT Filed: Nov. 10, 2014

(86) PCT No.: PCT/EP2014/074198
§ 371 (c)(1),
(2) Date: May 9, 2016

(87) PCT Pub. No.: WO2015/067807
PCT Pub. Date: May 14, 2015

(65) Prior Publication Data
US 2016/0271437 A1 Sep. 22, 2016

(30) Foreign Application Priority Data
Nov. 8, 2013 (GB) ..... 1319777.7

(51) Int. Cl.
*A63B 21/00* (2006.01)
*A63B 21/16* (2006.01)
(Continued)

(52) U.S. Cl.
CPC ..... *A63B 21/062* (2013.01); *A63B 21/0083* (2013.01); *A63B 21/0087* (2013.01);
(Continued)

(58) Field of Classification Search
CPC ..... A63B 21/062; A63B 21/0628; A63B 21/0626; A63B 21/4047; A63B 21/4035;
(Continued)

(56) References Cited

U.S. PATENT DOCUMENTS 4,448,412 A * 5/1984 Brentham ..... A63B 21/0083 188/285
4,647,041 A * 3/1987 Whiteley ..... A63B 21/015 482/113
(Continued)

FOREIGN PATENT DOCUMENTS

EP 2269698 1/2011
FR 2552671 4/1985
(Continued)

OTHER PUBLICATIONS

Minguet, Yves, EP 2269698, Jun. 16, 2009.*
(Continued)

*Primary Examiner* — Garrett K Atkinson
(74) *Attorney, Agent, or Firm* — Preston Smirman; Smirman IP Law, PLLC

(57) ABSTRACT

An apparatus for physical exercise comprising a resistance arrangement having at least one hydraulic cylinder adapted for providing resistance forces in at least a first and a second direction, the apparatus having a force transmission assembly through which the resistance forces are operable. The force transmission assembly having at least one actuation member being in operable engagement therewith and being adapted to transfer forces generated by a user in at least two directions of motion to the at least one hydraulic cylinder via the force transmission assembly. The resistance forces created by the at least one hydraulic cylinder opposing the user generated forces.

23 Claims, 9 Drawing Sheets

(51) Int. Cl.

| | |
|---|---|
| ***A63B 22/20*** | (2006.01) |
| ***A63B 23/12*** | (2006.01) |
| ***A63B 21/008*** | (2006.01) |
| ***A63B 21/055*** | (2006.01) |
| ***A63B 21/062*** | (2006.01) |
| ***A63B 23/035*** | (2006.01) |

(52) U.S. Cl.
CPC ..... *A63B 21/0626* (2015.10); *A63B 21/0628* (2015.10); *A63B 21/15* (2013.01); *A63B 21/16* (2013.01); *A63B 21/4035* (2015.10); *A63B 21/4047* (2015.10); *A63B 22/203* (2013.01); *A63B 23/0355* (2013.01); *A63B 23/03525* (2013.01); *A63B 23/12* (2013.01); *A63B 21/055* (2013.01); *A63B 21/0552* (2013.01)

(58) Field of Classification Search
CPC ..... A63B 22/203; A63B 23/12; A63B 21/15; A63B 21/16; A63B 23/0355; A63B 23/03525; A63B 21/0083; A63B 21/0087; A63B 21/055; A63B 21/0552
See application file for complete search history.

(56) References Cited

U.S. PATENT DOCUMENTS 4,786,051 A * 11/1988 Mullican ..... A63B 21/0083 188/282.1
4,848,739 A * 7/1989 Schaub ..... A63B 21/00072 482/113
4,911,436 A * 3/1990 Lighter ..... A63B 21/0087 482/113
5,114,389 A * 5/1992 Brentham ..... A63B 21/0083 482/113
5,125,884 A * 6/1992 Weber ..... A63B 21/4029 482/142
5,419,750 A * 5/1995 Steinmetz ..... A63B 23/0211 482/111
5,618,250 A * 4/1997 Butz ..... A63B 21/0615 482/134
5,746,688 A * 5/1998 Prager ..... A63B 23/03533 482/130
6,500,099 B1 * 12/2002 Eschenbach ..... A63B 21/152 482/121
7,481,752 B2 * 1/2009 Garner ..... A63B 21/0083 482/112
7,635,323 B2 * 12/2009 Halbridge ..... A63B 21/026 482/121
2002/0037793 A1 * 3/2002 Eschenbach ..... A63B 21/152 482/140
2002/0098957 A1 * 7/2002 Webber ..... A63B 21/4035 482/138
2005/0277526 A1 * 12/2005 Bonnell ..... A63B 23/0494 482/123
2011/0092343 A1 * 4/2011 Habing ..... A63B 23/1254 482/94
2012/0309598 A1 * 12/2012 Brentham ..... A63B 21/0083 482/112

FOREIGN PATENT DOCUMENTS

| | | |
|---|---|---|
| FR | 2701852 | 9/1994 |
| WO | 2006051247 | 5/2006 |

OTHER PUBLICATIONS

International Preliminary Report on Patentability dated May 10, 2016.
International Search Report dated Feb. 9, 2015.
Written Opinion of the International Searching Authority dated Feb. 19, 2015.
English Abstract of EP2269698.
English Abstract of FR2552671.
English Abstract of FR2701852.

* cited by examiner

APPARATUS FOR PHYSICAL EXERCISE

CROSS-REFERENCE TO RELATED APPLICATION

The instant application is a national phase of PCT International Application No. PCT/EP2014/074198 filed Nov. 10, 2014,and claims priority to GB Patent Application Serial No. 1319777.7 filed Nov. 8, 2013,the entire specifications of both of which are expressly incorporated herein by reference The present invention relates to an apparatus for physical exercise and in particular to a dual resistance apparatus.

Exercise equipment which takes advantage of biased or resilient members to create resistance has been well disclosed in prior art. The user acts against the resistance created and in doing so works particular muscle groups associated with a particular movement. Typically, the devices of the prior art provide resistance in one direction so that the user must use their own strength to move a part of the apparatus in a first direction against the direction of resistance. Once the movement is completed and the direction of movement is reversed, the resistive force is removed and the user can return the apparatus to its original state without resistance.

Some devices are known which provide a resistive force in both the first direction and the reverse direction. These devices are mostly complicated and involve electronics to control the resistive forces increasing cost and complexity further.

Still more solutions are available that incorporate larger ranges of motion or resisted motion in two directions, but these machines tend to be cumbersome in size and shape and often require adjustments to allow resistance in different directions. As a result, a user would have to stop between exercises to adapt the machine.

It is an object of the present invention to obviate or mitigate the problem of providing a dual resistance exercise apparatus having a range of motion useful for multiple exercise types and at a non-prohibitive cost.

Accordingly, the present invention provides an apparatus for physical exercise comprising;

a resistance arrangement having at least one resistance means adapted for providing resistance forces in at least a first and a second direction;

a force transmission assembly through which the resistance forces are operable, at least one actuation means being in operable engagement with the force transmission assembly and being adapted to transfer forces generatable by a user in at least two directions of motion to the at least one resistance means via the force transmission assembly, the resistance forces opposing the user generatable forces.

Ideally, the apparatus for physical exercise comprises a means for operably engaging the resistance means locatable between the resistance means and the force transmission assembly.

Preferably, means for engaging the resistance means is operably couplable to the actuation means.

Preferably, the force transmission assembly has linkage means for linking to the means for operably engaging the resistance means.

Ideally, the linkage means is operable between the means for operably engaging the resistance means and the actuation means.

Ideally, the linkage means facilitates movement of the resistance means in both directions of motion of the resistance means.

Preferably, the actuation means is adapted to transfer forces generatable by a user in at least two directions of motion to the means for operably engaging the resistance means via the linkage means, the resistance forces opposing the user generatable forces.

Preferably, manipulation of the actuation means results in movement of the linkage means and resulting movement of the means for operably engaging the resistance means.

Advantageously, the means for operably engaging the resistance means is linked by the linkage means and the user manipulates the linkage means via the actuation means to operate the apparatus. Whichever direction the linkage means is moved, resistance is encountered as the means for operably engaging the resistance means will encounter resistance to movement in that direction.

Further advantageously, user generated forces can be opposed in at least two directions of motion without making adjustments to the apparatus, providing a more thorough physical workout.

Ideally, the resistance arrangement comprises at least one hydraulic cylinder.

Preferably, the resistance arrangement comprises two hydraulic cylinders.

Ideally, the resistance arrangement comprises a dual action hydraulic cylinder.

Preferably, the means for engaging the resistance means has one or two ends.

Ideally, the linkage means is operably engaged with at least one end of the means for engaging the resistance means.

Ideally, the linkage means is operably engaged with at least an upper end of the means for engaging the resistance means.

Preferably, the linkage means is a rigid linkage means.

Ideally, the actuation means is movably coupled to a support structure or frame.

Ideally, the actuation means is rotatably mountable to a support structure or frame.

Preferably, the apparatus has a support means and the actuation means comprises means for movably coupling the actuation means to the support means.

Preferably, the actuation means comprises an axle rotatably mountable to the support structure or frame.

Ideally, the linkage means is in fixed connection with the actuation means at a first end.

Preferably, the linkage means is fixably attached to the axle of the actuation means.

Ideally, the linkage means extends from the axle of the actuation means in a direction substantially perpendicular to the axial direction of the axle of the actuation means.

Preferably, movement of the actuation means causes an arcuate movement of the end of the linkage means distal the end fixably attached to the actuation means.

Ideally, the linkage means is in rotatable connection with the means for engaging the resistance means.

Ideally, the linkage means is in rotatable connection with the means for engaging the resistance means at a second end distal the first end.

Preferably, a joining means is locatable between the linkage means and the means for engaging the resistance means.

Ideally, the linkage means is in rotatable connection with the joining means.

Preferably, the means for engaging the resistance means is in rotatable connection with the joining means.

Ideally, the resistance arrangement is pivotally mounted to a support structure or frame.

Preferably, the resistance arrangement is pivotally mounted to the support structure or frame at an end distal the end closest to the linkage means.

Advantageously, as the actuation means is moved causing arcuate movement of the linkage means, the combination of the pivotal mounting of the resistance arrangement and the at least one rotatable connection between the linkage means and the means for engaging the resistance means permits pulling/pushing of the means for engaging the resistance means in an axial direction of the resistance arrangement throughout the arcuate movement of the linkage means and directly against the resistance provided by the resistance arrangement.

Ideally, the first and second ends of the means for engaging the resistance means are operably engaged by the linkage means.

Ideally, the first and second ends of the means for operably engaging the resistance means are linked by the linkage means such that movement of the linkage means in one direction results in the linkage means pulling on the first end of the means for operably engaging the resistance means, movement in the opposing direction results in pulling on the second end thereof.

Advantageously, the resistance to movement is experienced in both directions of motion of the actuation means and during all phases of the motion.

Preferably, whichever end of the means for operably engaging the resistance means is pulled, a force resistive to motion in the pulled direction is experienced.

Alternatively, the resistance means is one or more pneumatic cylinders, springs, or other such suitable means for providing resistance.

Preferably, the linkage means has a linkage member.

Ideally, the linkage member forms an endless connection to the engagement means.

Preferably, the linkage means forms an endless connection between the first and second ends of the means for operably engaging the resistance means.

Ideally, the linkage member forms an endless path when connected to the resistance arrangement.

Preferably, the linkage member is a chain, belt, or other such elongate flexible member which forms an endless path of connection when connected to the resistance arrangement.

Ideally, the linkage member has two ends, each end being operably engagable with an end of the means for operably engaging the resistance means, forming an endless connection.

Preferably, the linkage means has at least two support means.

Ideally, the support means comprise a support around which the linkage member passes.

Preferably, the linkage means has two support means, one locatable on each side of the resistance arrangement.

Ideally, the support means are locatable on opposing sides of the resistance arrangement in alignment with the main axis of movement of the resistance arrangement.

Preferably, at least part of the outer circumference of the support means is in alignment with the main axis of movement of the resistance arrangement.

Ideally, the support means are rotatable such that they rotate as the linkage member passes thereover.

Ideally, the support means are cogs or the like.

Alternatively, the support means are pulleys or the like.

Ideally, the cogs have teeth for operable engagement with at least a portion of the chain.

Ideally, the apparatus has a supporting structure or frame.

Ideally, the housing of the resistance arrangement is fixed to the supporting structure such that movement of the means for operably engaging the resistance means does not result in movement of the housing of the resistance arrangement.

Preferably, the linkage support means are mountable on the supporting structure.

Ideally, the linkage support means are mountable via an axle to the supporting structure.

Preferably, the linkage support means are rotatable about the axle.

Ideally, the axle is rotatable with respect to the supporting structure.

Preferably, the axle of the linkage support means is mountable such that its axis is substantially perpendicular to the axis of movement of the at least one resistance means.

Ideally, the two linkage supporting means are mountable such that one is below and one is above the resistance arrangement during use.

Ideally, the two linkage support means are mountable one above and one below the resistance arrangement in alignment with the axis of movement of the resistance means.

Preferably, the two linkage support means are mountable such that the linkage member passes thereover and is at least partially tensioned therebetween.

Ideally, the actuation means is a user operated actuation means.

Preferably, the actuation means comprises at least one handle, pad, surface, or other such feature with which a user interacts.

Ideally, the actuation means comprises at least one lever arm.

Preferably, the actuation means comprises two lever arms.

Ideally, the two lever arms are joined to form one user actuator.

Preferably, the at least one lever arm is in operable engagement with at least one of the linkage support means.

Ideally, the lever arms are in operable engagement with at least one of the linkage support means.

Ideally the lever arm is operably engaged to the at least one support means at or about one end of the lever arm.

Preferably, a portion of the at least one lever arm which extends from the operable engagement with the at least one linkage support means forms a user interaction portion.

Preferably, the actuation means is operably engagable with the axle of the at least one linkage support means.

Ideally, the at least one lever arm is operably engagable with the axle of the at least one linkage support means.

Preferably, at least a portion of the axle of the at least one linkage support means extends through the supporting structure.

Preferably, a portion of the axle of the at least one linkage support means extends through the supporting structure on each side of the supporting structure.

Ideally, the lever arms are operably engagable with the portions of the axle of the at least one linkage support means which extend through the supporting structure.

Preferably, the lever arms are operably engagable with the upper linkage support means.

Advantageously, as the lever arm is rotated about its engagement with the linkage support means, it forces the axle of the linkage support means to rotate and as a result, the linkage member to pass over the linkage support means, pulling the means for operably engaging the resistance means from at least one end of the resistance arrangement.

Preferably, the user interaction portion has handles or grips thereon.

Ideally, a user grips the handles or grips during use.

Ideally, the user interaction portion has padding thereon.

Preferably, a user contacts the padding with their shoulders or any other relevant body part during use.

Ideally, the dual action hydraulic cylinder and associated engaging means are of sufficient length such that the range of motion of the actuation means is sufficient to allow a wide range of exercise to be performed.

Ideally, the range of motion of the lever arm is greater than 90 degrees.

Preferably, the range of motion of the lever arm is greater than 110 degrees.

Ideally, the range of motion of the lever arm is less than 175 degrees.

Preferably, the range of motion of the lever arm is less than 150 degrees.

Most preferably, the range of motion of the lever arm is 125 degrees.

Preferably, the lever arm has ballast means.

Ideally, the ballast means is locatable at the end of the lever arms distal the user interaction portion.

Preferably, the ballast means is locatable on the lever arm on the other side of the axle of the linkage support means to the user interaction portion.

Preferably, the connection of the lever arm to the linkage support means is locatable between the ballast and the user interaction portion.

Advantageously, the ballast means helps to balance the weight of the lever arm such that the lever arm does not move when the user is not causing their movement.

Alternatively, the ballast means is locatable on the linkage means or otherwise inside the support structure.

Preferably, the dual action hydraulic cylinder comprises a hollow cylindrical body portion.

Ideally, the hollow cylindrical body portion has an opening on at least one end face.

Preferably, the hollow cylindrical body portion has an opening on each end face.

Ideally, the dual action hydraulic cylinder has a piston head having a piston rod extending therefrom.

Preferably, the dual action hydraulic cylinder has a piston head having a plurality of piston rods extending therefrom.

Preferably, the piston head has a hollow cylindrical body facing portion and two end faces which face the end faces of the hollow cylindrical body portion.

Ideally, the piston head is locatable within the hollow cylindrical body portion and is of a size just less than the internal size of the hollow cylindrical body portion.

Preferably, a piston rod extends from one or both faces of the piston head and extends out through the opening in one or both end faces of the hollow cylindrical body portion.

Ideally, the hollow cylindrical body portion is sealed about its end faces about the one or more openings for the one or more piston rods.

Preferably, hydraulic fluid is provided internal the hollow cylindrical body portion and on each side of the piston head.

Ideally, the portions of the hollow cylindrical body each side of the piston head are in fluid communication with each other.

Preferably, the supporting structure is a support frame.

Ideally, the supporting structure is fixed to the ground.

Preferably, the supporting structure is manufactured from steel or other such suitably strong material.

Ideally, the supporting structure will have an aesthetic cladding or other such aesthetic treatment applied thereto.

Ideally, the resistance arrangement, and linkage means are locatable within the boundary of the supporting structure.

The invention will now be described with reference to the accompanying drawings which show by way of example three embodiments of a physical exercise apparatus in accordance with the invention. In the drawings.

Figure 1:
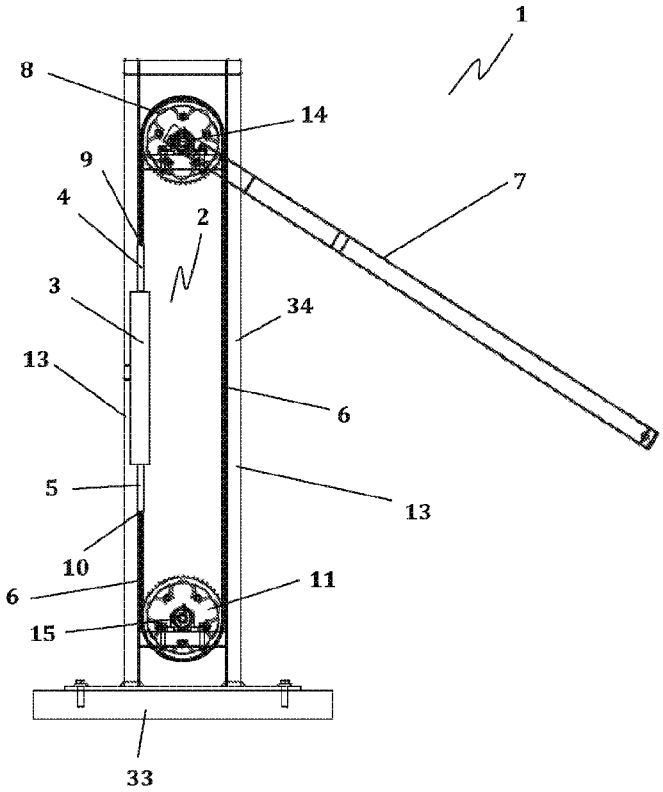
FIG. 1 is a side sectional view of the apparatus for physical exercise showing the linkage means.

In the drawings, there is shown an apparatus for physical exercise indicated generally by the reference numeral 1 comprising a resistance arrangement 2 having a dual action hydraulic cylinder 3 for generating resistive forces in a first and a second direction. The resistive forces acting through at least first and second piston rods 4, 5 of the resistance arrangement 2 respectively. A chain 6 links the first and second piston rods 4, 5 in operable engagement and at least one actuation member 7 is in operable engagement with the chain via an upper cog 8. The actuation member 7 is adapted to transfer forces generated by a user in two directions of motion to the piston rods 4, 5 via the chain 6. The user generated forces opposing one resistive force provided by the resistance arrangement 2 in each direction of motion. As a result, manipulation of the actuation member 7 results in rotation of the upper cog 8 and resulting translation of the piston rods 4, 5. As the piston rods 4, 5 are linked by the chain 6 and the user manipulates the chain 6 via the upper cog 8 and actuation member 7 to operate the apparatus 1, whichever direction the chain 6 is moved resistance is encountered as one or the other of the piston rods 4, 5 will experience resistance in that direction due to the compression and restricted flow of hydraulic fluid in the cylinder. The piston rods 4, 5 are linked by the chain 6 such that movement of the chain 6 in one direction results in the chain 6 pulling on the upper piston rod 4, and movement of the chain 6 in the opposing direction results in pulling on the lower piston rod 5. As a result, the resistance to movement is experienced in both directions of motion and during all phases of the motion.

The chain 6 has two ends 9, 10, each end being operably engaged with one of the two piston rods 4, 5, forming an endless or closed loop connection.

The chain has two support members in the form of cogs 8, 11, one being the upper cog 8 and the other being a lower cog 11. The chain 6 passes around the cogs 8, 11 and one cog is located on each side of the resistance arrangement 3. The outer circumference of the cogs 8, 11 are located in alignment with the main axis of the hydraulic cylinder 3. The cogs 8, 11 are rotatable such that they rotate as the chain 6 passes thereover, the cogs 8, 11 having teeth 12 for operable engagement with at least a portion of the chain 6.

Figure 2:
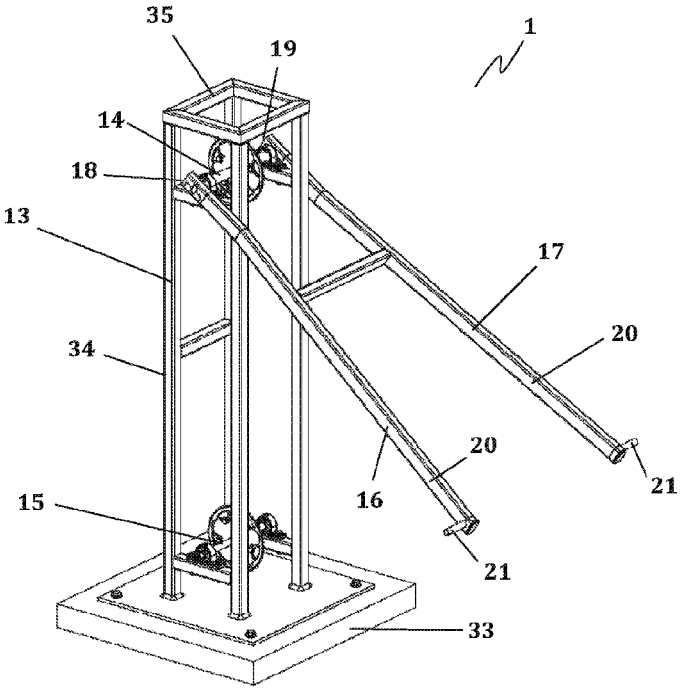
FIG. 2 is a perspective view of the apparatus for physical exercise.

The resistance arrangement 2 is fixed to a supporting structure 13 such that movement of the piston rods 4, 5 does not result in movement of the housing of the resistance arrangement 2. The cogs 8, 11 are mountable on the supporting structure 13 via axles 14, 15 (best shown in FIG. 2) which are rotatable with respect to the supporting structure 13. The axles of the cogs 4, 5 are mountable such that their axis is substantially perpendicular to the axial direction of motion of the dual action hydraulic cylinder 3 and the piston rods 4, 5. The two cogs 8, 11 are mountable such that the chain 6 passes thereover and is at least partially tensioned therebetween. The chain tension is adjustable to suit the application.

Figure 5:
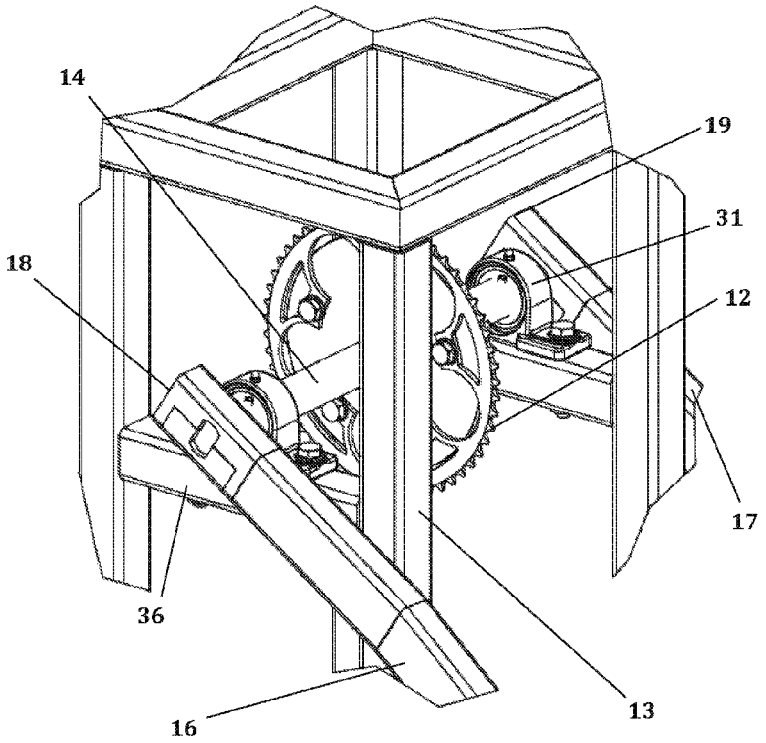
FIG. 5 is a close-up perspective view of the upper linkage means support means.

The actuation member 7 comprises two lever arms 16, 17 joined to form one actuation member 7. The lever arms 16, 17 are in operable engagement with the axle 14 of the upper cog 8 at or about one end 18, 19 of the lever arms 16, 17 respectively. The portion of the lever arms 16, 17 distal to the operable engagement with the axle 14 of the upper cog 8 form a user interaction portion 20 with handles 21 thereon. At least a portion of the axle 14 of the upper cog 8 extends through two bearing housings 31 (best shown in FIG. 5) of the supporting structure 13 on each side of the supporting structure 13 and the lever arms 16, 17 are operably engagable with the portions of the axle 14 of the upper cog 8 which extend through the bearing housings 31 of the supporting structure 13.

As the lever arms 16, 17 are rotated about their engagement with the axle 14 of the upper cog 8, it forces the axle 14 and cog 8 to rotate and as a result, causes the chain 6 to pass over the cog 8, pulling either one or the other of the piston rods 4, 5 from the dual action hydraulic cylinder 3 depending on the direction of motion applied.

Figure 6:
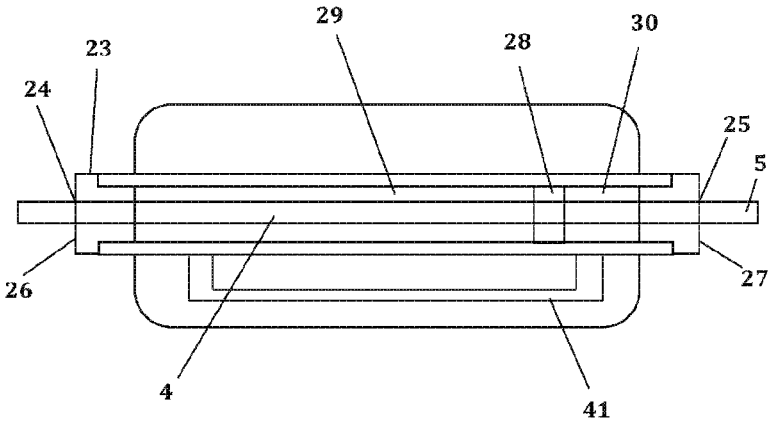
FIG. 6 is a sectional view of the resistance means.

The dual action hydraulic cylinder 3 (best illustrated in FIG. 6) and associated piston rods 4, 5 are of sufficient length such that the range of motion of the lever arms 16, 17 is sufficient to allow a wide range of exercise to be preformed, the range of motion being approximately 90-175 degrees.

Figure 3:
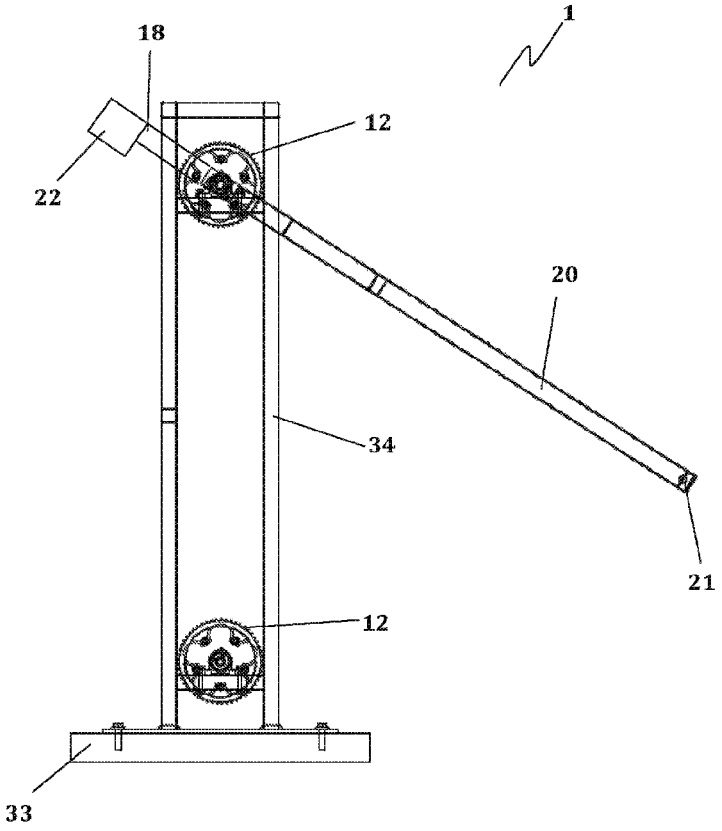
FIG. 3 is a side sectional view of the apparatus for physical exercise showing the ballast means.
Figure 4:
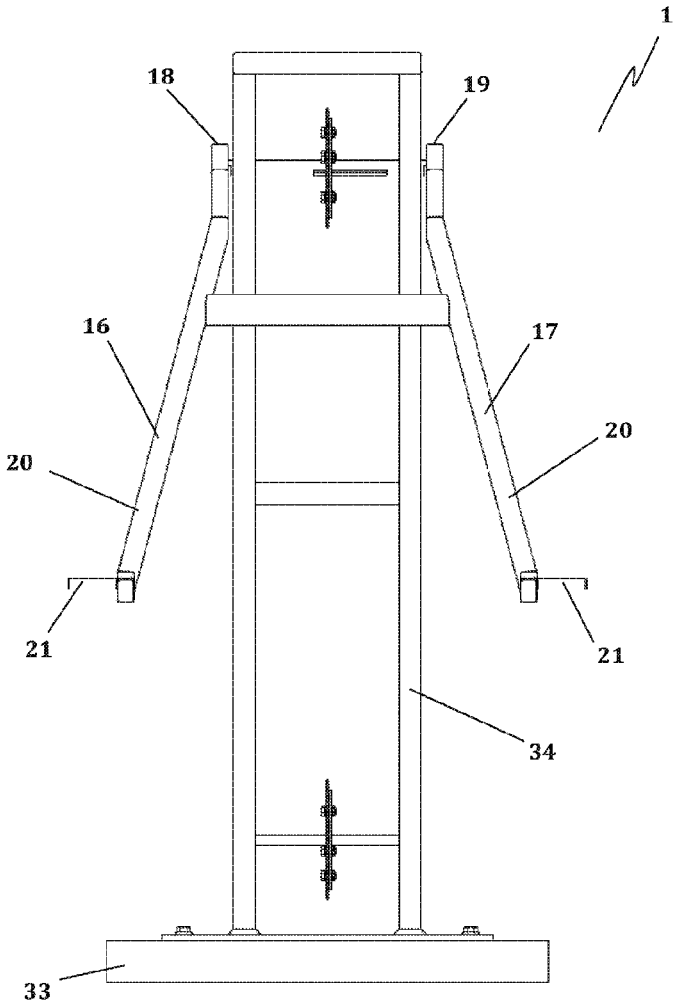
FIG. 4 is a front view of the apparatus for physical exercise.

In FIG. 3, the lever arms 16, 17 have ballast 22 located at the ends of the lever arms 18, 19 distal the user interaction portion 20 and the connection of the lever arms 18, 19 to the axle 14 of the upper cog 8 is locatable between the ballast 22 and the user interaction portion 20.

The ballast 22 helps to balance the weight of the lever arms 16, 17 such that the lever arms 16, 17 do not move when the user is not causing their movement.

The dual action hydraulic cylinder 3 comprises a hollow cylindrical body portion 23 having openings 24, 25 on each end face 26, 27 and a piston head 28 having the piston rods 4, 5 extending therefrom. The piston head 28 is located within the hollow cylindrical body portion 23 and is of a size just less than the internal size of the hollow cylindrical body portion 23. The piston rods 4, 5 extend out through the openings 24, 25 in each end face 26, 27 of the hollow cylindrical body portion 23 and the hollow cylindrical body portion 23 is sealed about its end faces 26, 27 at the openings 24, 25 for the piston rods 4, 5. Hydraulic fluid (not shown) is provided internal the hollow cylindrical body portion 23 and on each side 29, 30 of the piston head 28 and the portions 29, 30 of the hollow cylindrical body each side of the piston head 28 are in fluid communication with each other via a conduit 41 for controlling/restricting hydraulic fluid flow. The volume of the conduit 41 and the orifices connecting the inside of the hollow cylindrical body portion 23 with the conduit 41 can be predetermined to control the resistance forces.

Figure 7:
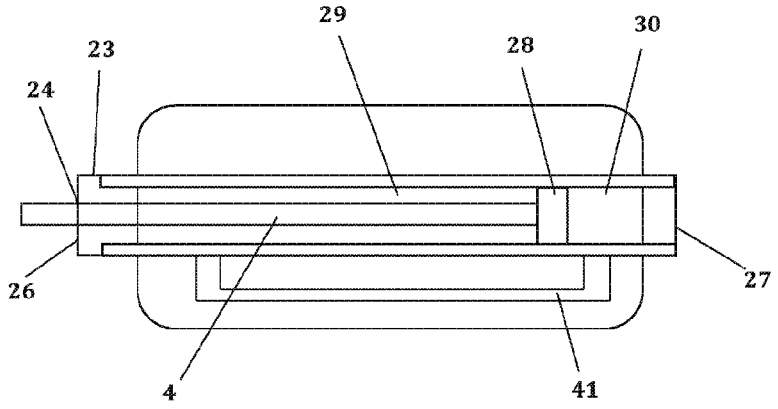
FIG. 7 is a sectional view of a resistance means having only one piston rod.

FIG. 7 shows a cylinder similar to that described above in reference to FIG. 6, having only one piston rod 4 extending therefrom.

The supporting structure 13 is a metallic frame has a heavy base 33 and is fixed to the ground. Four beams 34 extend upright from the base 33 defining a quadrangular shaped open frame. The upper ends of the four beams 34 are held together by a quadrangular cap 35. The axle bearing housings 31 are mounted on two parallel cross members 36 which span between the two pairs of mutually opposing beams 34. The support frame is reinforced using cross members 42 and/or in any other way necessary.

The supporting structure 13 may have an aesthetic cladding or other such aesthetic treatment applied thereto and may incorporate features such as a screen or other such visual display unit. The resistance arrangement 2 and chain 6 are located within the boundary of the four beams 34 of the supporting structure 13 enhancing the safety of the apparatus 1.

Figure 8:
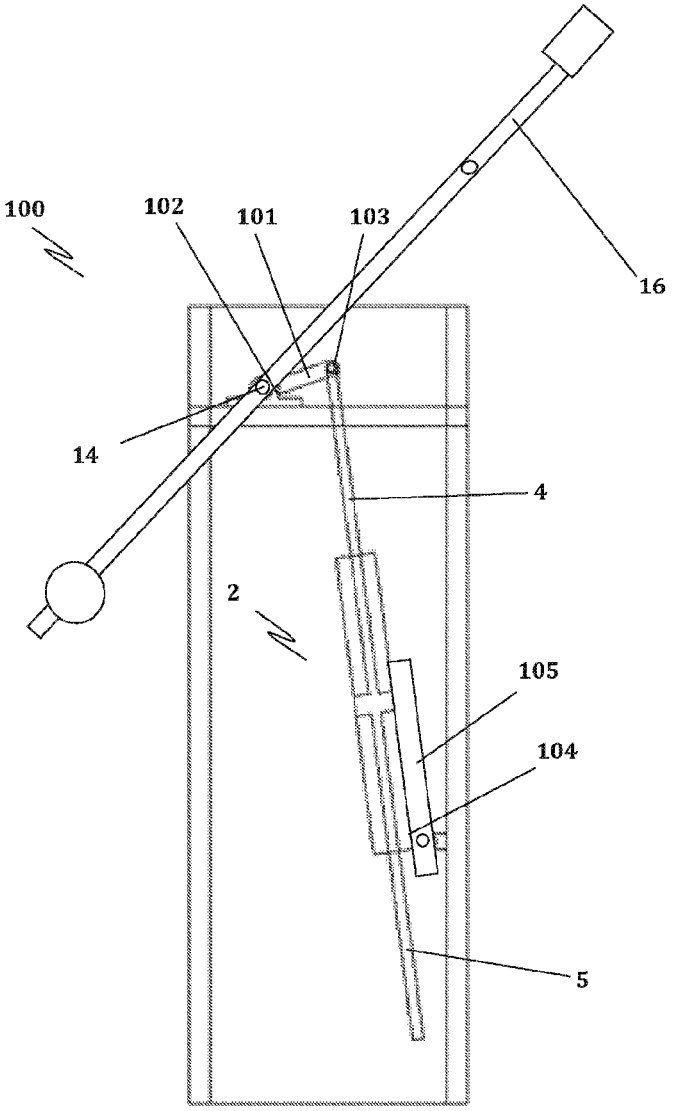
FIG. 8 is a side sectional view of a second embodiment of the apparatus having a rigid linking member and a resistance arrangement having two piston rods.

A second embodiment 100 of the invention is shown in FIG. 8 wherein chain 6 is replaced by a rigid linkage member 101. The rigid linkage member 101 is in fixed connection with the axle 14 and extends from the axle 14 in a direction substantially perpendicular to the axial direction of the axle 14. Movement of the axle 14 causes an arcuate movement of the end 102 of the linkage member 101 distal the end fixed to the axle 14. The linkage member 101 is in rotatable connection with the piston rod 4 a second end 103 distal the first end 102. The resistance arrangement 2 is pivotally mounted to a support structure 13 at an end 104 distal the end closest to the linkage member 101 either directly or via a mounting plate 105. As the user rotates the lever arms 16, 17, the axle 14 is moved causing arcuate movement of the linkage member 101, the combination of the pivotal mounting of the resistance arrangement 2 and the rotatable connection between the linkage member 101 and the piston rod 4 permits pulling/pushing of the piston rod 4 in an axial direction of the resistance arrangement 2 throughout the arcuate movement of the linkage member 101 and directly against the resistance provided by the resistance arrangement 2.

Figure 9:
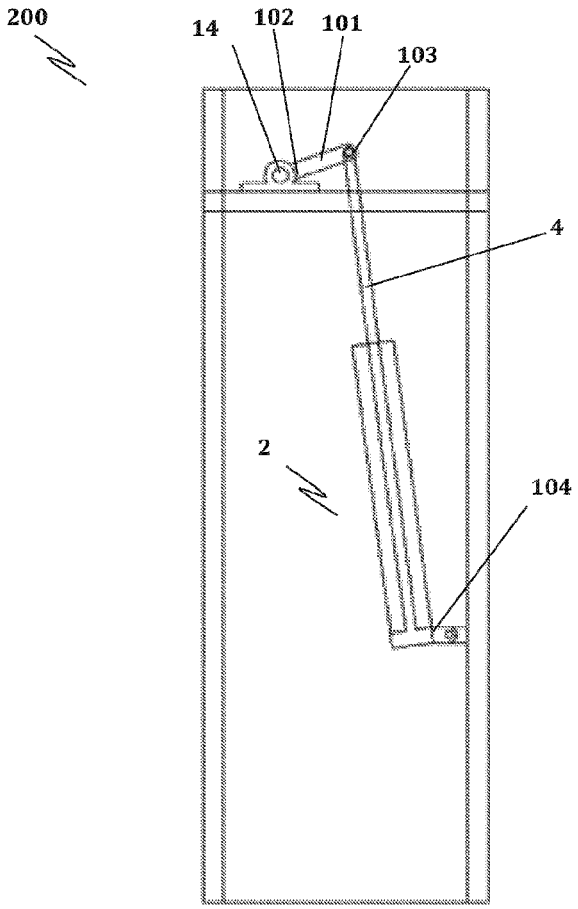
FIG. 9 is a side sectional view of a third embodiment of the apparatus having a rigid linking member and a resistance arrangement having one piston rod.

A third embodiment of the invention is shown in FIG. 9, the third embodiment comprising the same elements and functionality of the second embodiment but having a resistance arrangement 2 with only one piston rod 4.

In relation to the detailed description of the different embodiments of the invention, it will be understood that one or more technical features of one embodiment can be used in combination with one or more technical features of any other embodiment where the transferred use of the one or more technical features would be immediately apparent to a person of ordinary skill in the art to carry out a similar function in a similar way on the other embodiment.

In the preceding discussion of the invention, unless stated to the contrary, the disclosure of alternative values for the upper or lower limit of the permitted range of a parameter, coupled with an indication that one of the said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof as defined in the appended claims.

The invention claimed is:

1. An apparatus for physical exercise, comprising:

a resistance arrangement having at least one resistance means adapted for providing resistance forces in at least a first and a second direction;

a force transmission assembly through which the resistance forces are operable;

at least one actuation means being in operable engagement with the force transmission assembly and being adapted to transfer forces generatable by a user in at least two directions of motion to the at least one resistance means via the force transmission assembly;

wherein the resistance forces oppose the user generatable forces;

a support means;

wherein the actuation means comprises means for movably coupling the actuation means to the support means;

wherein the force transmission assembly comprises means for operably engaging the resistance means, and a linkage means operable between the means for operably engaging the resistance means and the actuation means; and a supporting structure or frame, wherein the resistance arrangement and linkage means are located within a boundary of the supporting structure or frame.

2. The apparatus for physical exercise as claimed in claim 1, wherein the resistance arrangement comprises a single hydraulic cylinder, two hydraulic cylinders, or a dual action hydraulic cylinder.

3. The apparatus for physical exercise as claimed in claim l, wherein the force transmission assembly is adapted to transfer forces generatable by the user in at least two directions of motion to the means for operably engaging the resistance means via the linkage means, the resistance forces opposing the user generatable forces.

4. The apparatus for physical exercise as claimed in claim 3, wherein the linkage means is a rigid linkage means.

5. The apparatus for physical exercise as claimed in claim 4, wherein the linkage means is in rotatable connection at a first end with at least one end of the means for operably engaging the resistance means.

6. The apparatus for physical exercise as claimed in claim 5, wherein the linkage means is operably couplable at a second end distal the first end to the actuation means so as to move therewith.

7. The apparatus for physical exercise as claimed in claim 6, wherein the linkage means and the means for engaging the resistance means have a joining means therebetween, both the linkage means and the means for engaging the resistance means being in rotatable connection with the joining means.

8. The apparatus for physical exercise as claimed in claim 7, wherein the resistance arrangement is movably mounted to the support structure or frame.

9. The apparatus for physical exercise as claimed in claim 8, wherein the linkage means has a linkage member, the linkage member forming an endless connection between the first and second ends of the means for operably engaging the resistance means.

10. The apparatus for physical exercise as claimed in claim 1, wherein first and second ends of the means for engaging the resistance means are operably engaged by the linkage means.

11. The apparatus for physical exercise as claimed in claim 1, wherein first and second ends of the means for operably engaging the resistance means are linked by the linkage means such that movement of the linkage means in one direction results in the linkage means pulling on the first end of the means for operably engaging the resistance means, movement in the opposing direction results in pulling on the second end thereof.

12. The apparatus for physical exercise as claimed in claim 1, wherein at least a portion of the resistance arrangement is fixed to the supporting structure such that movement of the means for operably engaging the resistance means does not result in movement of the entire resistance arrangement.

13. The apparatus for physical exercise as claimed in claim 12, wherein the actuation means comprises at least one, and preferably two, lever arms, the at least one lever arm being in operable engagement with the movable coupling means of the actuation means.

14. The apparatus for physical exercise as claimed in claim 13, wherein the at least one lever arm is operably engaged to the movable coupling means of the actuation means at or about a first end of the at least one lever arm, and forms a user interaction portion at a second end distal the first end.

15. The apparatus for physical exercise as claimed in claim 14, wherein a portion of the movable coupling means is an axle of the actuation means which extends through the supporting structure or frame on each side of the supporting structure or frame and protrude therefrom, the at least one lever arm being operably engagable with the protruding portions of the axle of the actuation means.

16. The apparatus for physical exercise as claimed in claim 15, wherein the user interaction portion has handles, grips, or padding thereon such that the user can grip or exert force against the handles, grips, or padding with at least a portion of the user's body.

17. The apparatus for physical exercise as claimed in claim 16, wherein the lever arm has ballast means locatable at or about the end of the at least one lever arm distal the end having the user interaction portion.

18. The apparatus for physical exercise as claimed in claim 17, wherein the ballast means is configured to balance the weight of the at least one lever arm such that the at least one lever arm does not move when the user is not causing movement.

19. The apparatus for physical exercise as claimed in claim 12, wherein the supporting structure or frame is fixed to the ground.

20. The apparatus for physical exercise as claimed in claim l, wherein the linkage means is a chain, belt, or other such elongate flexible member which forms an endless path of connection when connected to the resistance arrangement.

21. The apparatus for physical exercise as claimed in claim 1, wherein the actuation means is operable by the user.

22. The apparatus for physical exercise as claimed in claim 1, wherein a range of motion of the actuation means is between 90 degrees and 180 degrees.

23. The apparatus for physical exercise as claimed in claim 1, wherein the resistance arrangement comprises a dual action hydraulic cylinder having a hollow cylindrical body portion, the hollow cylindrical body portion further having an opening on at least one end face.

* * * * *